US007933540B2

(12) United States Patent
Thompson et al.

(10) Patent No.: US 7,933,540 B2
(45) Date of Patent: Apr. 26, 2011

(54) TRIMMING SYSTEM FOR STABILIZING IMAGE QUALITY FOR HIGH PERFORMANCE MAGNETIC BRUSH DEVELOPMENT

(75) Inventors: Michael D Thompson, Rochester, NY (US); Paul W Morehouse, Jr., Webster, NY (US)

(73) Assignee: Xerox Corporation, Norwalk, CT (US)

( * ) Notice: Subject to any disclaimer, the term of this patent is extended or adjusted under 35 U.S.C. 154(b) by 280 days.

(21) Appl. No.: 12/265,967

(22) Filed: Nov. 6, 2008

(65) Prior Publication Data

US 2010/0111575 A1 May 6, 2010

(51) Int. Cl.
*G03G 15/09* (2006.01)

(52) U.S. Cl. ..... 399/274; 399/264; 399/272; 399/273; 399/283; 399/284

(58) Field of Classification Search ..... 399/264, 399/272, 273, 274, 283, 284
See application file for complete search history.

(56) References Cited

U.S. PATENT DOCUMENTS 6,181,896 B1 * 1/2001 Zirilli et al. ..... 399/266
7,305,206 B2 12/2007 Hart et al.
7,333,753 B2 2/2008 Hart et al.
2006/0008281 A1 * 1/2006 Matsumoto et al. ..... 399/27

FOREIGN PATENT DOCUMENTS

JP 58016270 A * 1/1983

OTHER PUBLICATIONS

JP 58016270 A, English abstract to Nomura et al.*

* cited by examiner

*Primary Examiner* — Ryan D Walsh
(74) *Attorney, Agent, or Firm* — Lloyd F. Bean II

(57) ABSTRACT

A device for metering developer material to a predefined developer material bed height on a donor member, including a trim bar being mounted a predefined spacing from the donor member; and a magnetic member positioned adjacent and along the length of the trim bar, the magnetic member coacting with the trim bar to obtain the predefined developer material bed height on the donor member.

10 Claims, 7 Drawing Sheets

TRIMMING SYSTEM FOR STABILIZING IMAGE QUALITY FOR HIGH PERFORMANCE MAGNETIC BRUSH DEVELOPMENT

TECHNICAL FIELD

The present disclosure relates generally to an electrostatographic or xerographic printing machine, and more particularly concerns a trimming system for stabilizing image quality for high performance magnetic brush development.

BACKGROUND

Generally, an electrophotographic printing machine includes a photoconductive member which is charged to a substantially uniform potential to sensitize the surface thereof. The charged portion of the photoconductive member is exposed to an optical light pattern representing the document being produced. This records an electrostatic latent image on the photoconductive member corresponding to the informational areas contained within the document. After the electrostatic latent image is formed on the photoconductive member, the image is developed by bringing a developer material into proximal contact therewith. Typically, the developer material comprises toner particles adhering triboelectrically to carrier granules. The toner particles are attracted to the latent image from the carrier granules and form a powder image on the photoconductive member which is subsequently transferred to a copy sheet. Finally, the copy sheet is heated or otherwise processed to permanently affix the powder image thereto in the desired image-wise configuration.

In the prior art, both interactive and non-interactive development has been accomplished with magnetic brushes. In typical interactive embodiments, the magnetic brush is in the form of a rigid cylindrical sleeve which rotates around a fixed assembly of permanent magnets. In this type of development system, the cylindrical sleeve is usually made of an electrically conductive, non-ferrous material such as aluminum or stainless steel, with its outer surface textured to improve developer adhesion. The rotation of the sleeve transports magnetically adhered developer through the development zone where there is direct contact between the developer brush and the imaged surface, and toner is stripped from the passing magnetic brush filaments by the electrostatic fields of the image.

In the prior art, for two component magnetic brush development systems, the trim blade typically comprises an angled, straight edge blade spaced from the surface of the developer roll along the length thereof. The trim blade consists of a metal substrate. The trim blade is oriented so that the edge portion of the blade contacts developer particles on the surface of the development roll in order to smooth the layer of developer particles and control the mass of developer on the roll.

A significant disadvantage to conventional trim blades is that they deteriorate rather quickly. Particularly, the surface of the blade that contacts the developer particles tends to wear down over time. As the trim blade member is responsible for creating a uniform layer of developer across the developer roll, a deteriorated or worn trim blade compromises print quality. A constant gap between trim blade and developer roll must be maintained. When a trim blade wears indicated by degradation in the quality of the final image, it is necessary for a customer to replace it with a new trim blade or adjust the spacing between the developer roll and the trim blade to achieve the correct developer mass on the sleeve of the development roller. Often, this involves replacing a number of system elements that are collectively provided in a Customer Replaceable Unit (CRU). When a trim blade wears out, the entire CRU must be replaced, which is an expensive and time-consuming process.

The above problem is more acute in semiconducting magnetic brush systems (SCMB) that consist of thin brushes (low mass on sleeve, MOS) close spacing to the latent image and conductivity of the carrier midway between conductive and insulative. These systems are able to operate at very high speeds using low voltages. In these systems the MOS is controlled by a trim blade comprised of two parts, a non-magnetic structural part and a soft magnetic part which couples to the magnetic field of the developer roll. This magnetic part of the trim blade is spaced from the developer roll along its length and leads to a very uniform thin layer of developer on the development roll surface. The MOS is a critical parameter which controls solid area, background and line quality. This CP is factory adjusted and the process is designed to be fairly insensitive to variation in MOS. However, failure modes exist in which material and/or roll surface and/or metering blade age leads to variation in MOS which in turn leads to degraded image quality making it difficult to maintain color quality consistently over time and between marking engines. A current solution to this problem is to replace the worn development system components. Another problem comes in trying to clear developer from SCMB magnetic rolls in multipass systems; currently one needs to cam the development system away from the photoreceptor which adds expensive components.

SUMMARY

The present invention obviates the problems noted above by providing an apparatus and method to dynamically control MOS for optimal performance in an advanced SCMB development system. The MOS can be sensed with an optical or similar sensor, (the brush is thin and we can reflect light off the magnetic roller surface at a magnetic pole position). The MOS can be varied by rotation of an auxiliary trim magnet near the trim bar. This variation in magnetic field near the magnetic trim used in SCMB systems has been discovered here to be a very effective control for mass on the roll even at very high roll surface speeds (>1 m/sec). The sensitivity of MOS to angle can be controlled by strength of the trim magnet. This unique actuator would be important for color consistency where we want very small fluctuations in color over long runs or in situations where we need consistent image quality between different marking engines. By monitoring and controlling toner concentration and MOS we can keep the state of the developer in the development nip constant and thereby obtain more consistent color development. This approach also offers the potential to reduce factory set up time by allowing an accurate setting of MOS which is currently a very time consuming and error prone process.

There is provided a device for metering developer material to a predefined developer material bed height on a donor member, including a trim bar being mounted on a predefined spacing from said donor member; and a magnetic member positioned adjacent and along the length of said trim bar, said magnetic member coacting with said trim bar to obtain said predefined developer material bed height on the donor member.

DETAILED DESCRIPTION

Figure 1:
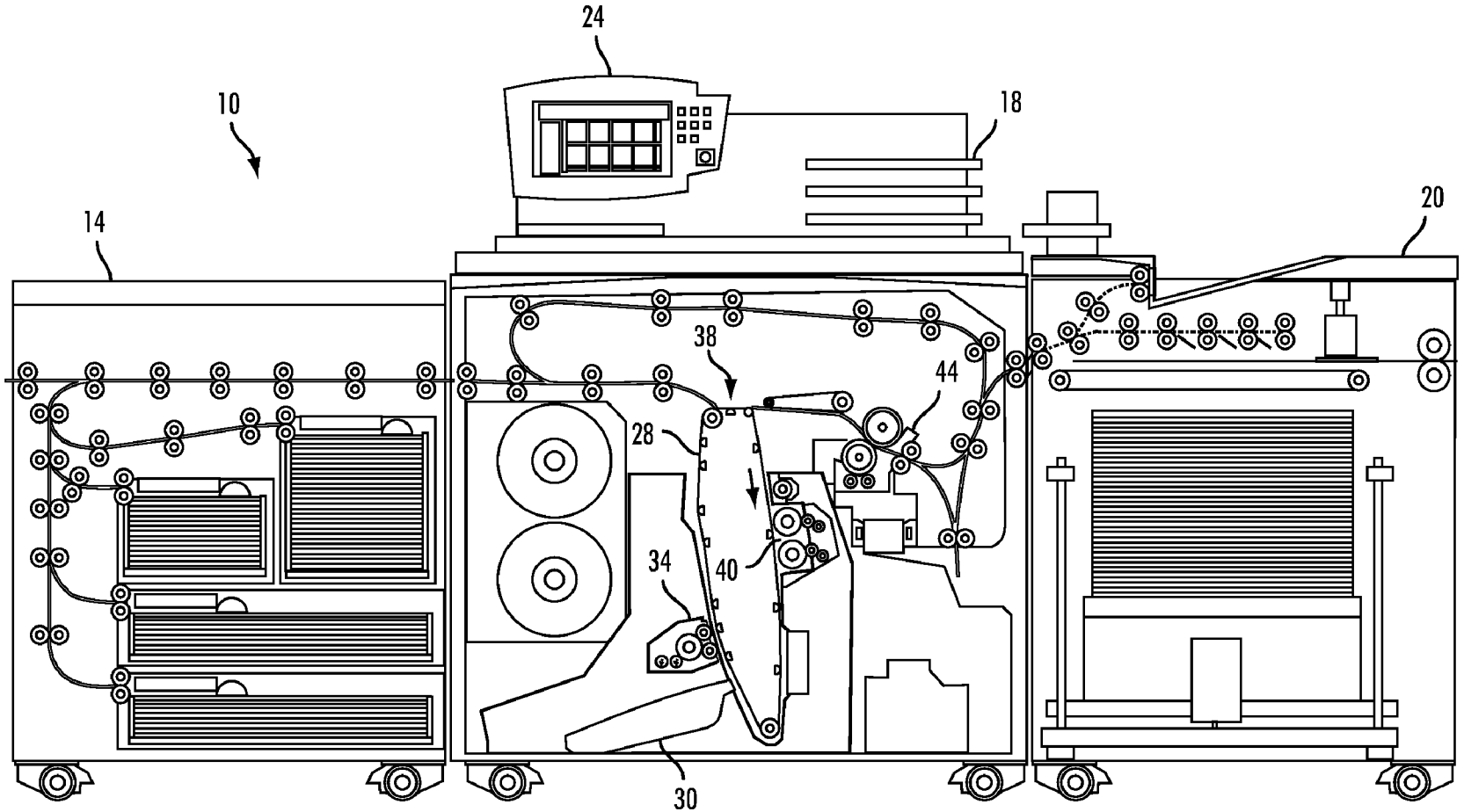
FIG. 1 is an elevational view of an electrostatographic printing apparatus incorporating a semiconductive magnetic brush development (SCMB) system.

FIG. 1 is an elevational view of an electrostatographic printing apparatus 10, such as a printer or copier, having a development subsystem that uses two magnetic rolls for developing toner particles that are carried on semiconductive carrier particles. The printing apparatus 10 includes a feeder unit 14, a printing unit 18, and an output unit 20. The feeder unit 14 houses supplies of media sheets and substrates onto which document images are transferred by the printing unit 18. Sheets to which images have been fixed are delivered to the output unit 20 for correlating and/or stacking in trays for pickup.

The printing unit 18 includes an operator console 24 where job tickets may be reviewed and/or modified for print jobs performed by the printing apparatus 10. The pages to be printed during a print job may be scanned by the printing apparatus 10 or received over an electrical communication link. The page images are used to generate bit data that are provided to a raster output scanner (ROS) 30 for forming a latent image on the photoreceptor 28. Photoreceptor 28 continuously travels the circuit depicted in the figure in the direction indicated by the arrow. The development subsystem 34 develops toner on the photoreceptor 28. At the transfer station 38, the toner conforming to the latent image is transferred to the substrate by electric fields generated by the transfer station. The substrate bearing the toner image travels to the fuser station 44 where the toner image is fixed to the substrate. The substrate is then carried to the output unit 20. This description is provided to generally describe the environment in which a double magnetic roll development system for developer having semiconductive carrier particles may be used and is not intended to limit the use of such a development subsystem to this particular printing machine environment.

Figure 2:
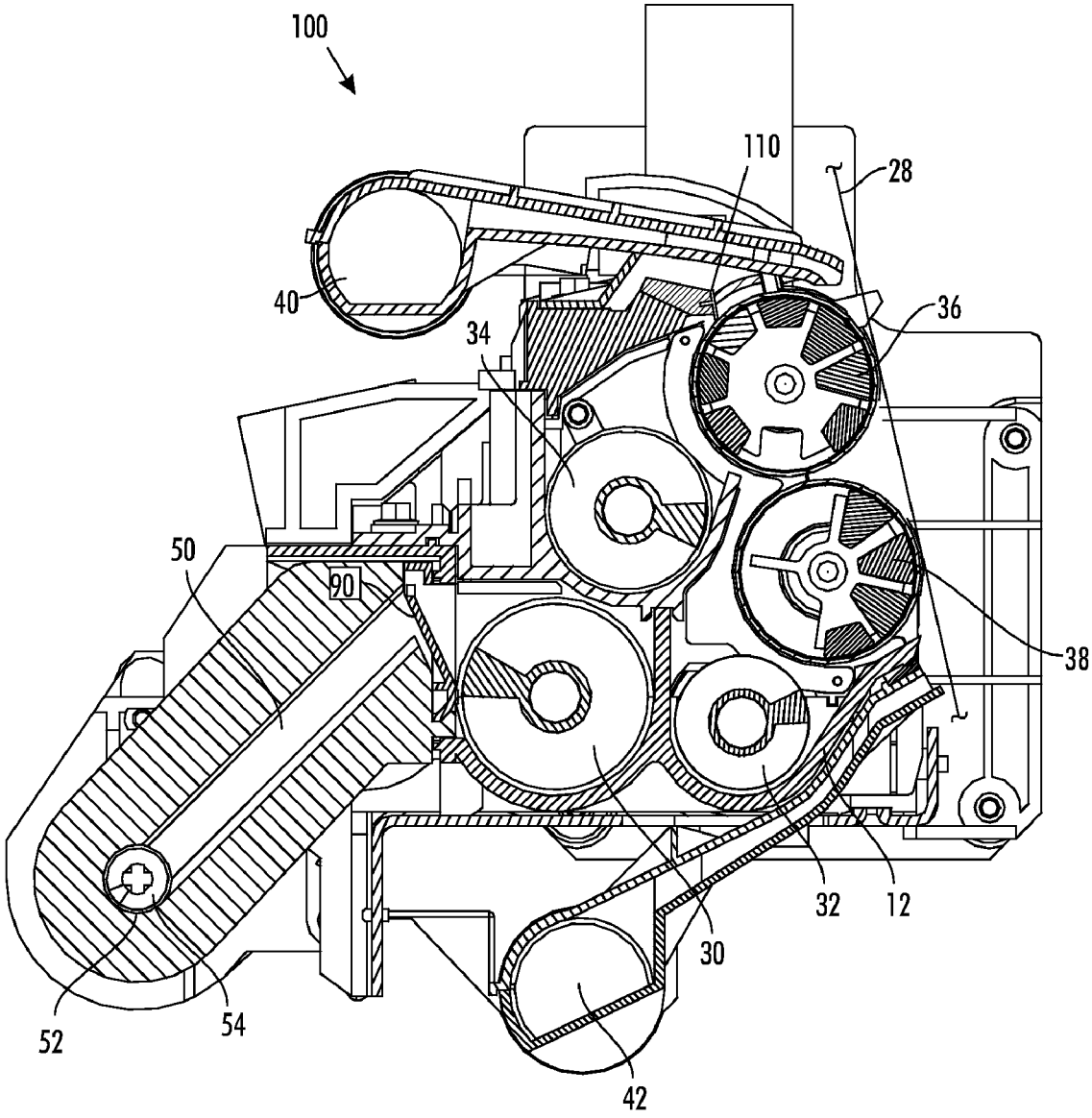
FIG. 2 is a sectional view of a SCMB developer unit having two magnetic rolls.

The overall function of developer unit 100, which is shown in FIG. 2, is to apply marking material, such as toner, onto suitably-charged areas forming a latent image on an image receptor such as the photoreceptor 28, in a manner generally known in the art. The developer unit 100, however, provides a longer development zone while maintaining an adequate supply of developer having semiconductive carrier particles than development systems previously known. In various types of printers, there may be multiple such developer units 100, such as one for each primary color or other purpose.

Among the elements of the developer unit 100, which is shown in FIG. 2, are a housing, which functions generally to hold a supply of developer material having semiconductive carrier particles, as well as augers, such as 30, 32, 34, which variously mix and convey the developer material, and magnetic rolls 36, 38, which in this embodiment form magnetic brushes to apply developer material to the photoreceptor 28. Other types of features for development of latent images, such as donor rolls, paddles, scavengeless-development electrodes, commutators, etc., are known in the art and may be used in conjunction with various embodiments pursuant to the claims. In the illustrated embodiment, there is further provided air manifolds 40, 42, attached to vacuum sources (not shown) for removing dirt and excess particles from the transfer zone near photoreceptor 28. As mentioned above, a two-component developer material is comprised of toner and carrier. The carrier particles in a two-component developer are generally not applied to the photoreceptor 28, but rather remain circulating within the housing 12. The augers 30, 32, and 34 are configured and cooperate in a manner described in co-pending U.S. application Ser. No. 11/263,370, now U.S. Pat. No. 7,305,206, which was filed on Oct. 31, 2005, entitled "Xerographic Developer Unit Having Variable Pitch Auger," and co-pending U.S. application Ser. No. 11/263,371, now U.S. Pat. No. 7,333,753, which was filed on Oct. 31, 2005, entitled "Developer Housing Design With Improved Sump Mass Variation Latitude", both of which are hereby expressly incorporated herein in their entireties by reference and are commonly assigned to the assignee of this patent application.

As is well known, magnetic rolls, such as magnetic rolls 36 and 38, are comprised of a rotating sleeve and a stationary core in which magnets are housed. In order to provide a surface that impedes the slippage of carrier particles as the outer sleeve rotates, the outer surface of the rotating sleeve may be sand-blasted or grooved. Previously known SCMB systems used sand-blasted stainless steel rollers, but these rollers have relatively short functional life of approximately 2 million prints or copies. Other known magnetic brush systems that use other types of developers used grooved stainless steel rollers having a depth of approximately 200 to 250 microns. The use of these grooved rollers in a double magnetic roller development subsystem operating in the against mode reduced the trim gap for the development subsystem from approximately 0.7 mm to approximately 0.135 mm. The trim gap is the distance between the trim blade and the upper magnetic roll 36. The trim blade assists in the removal of excess developer from the upper magnetic roll 38 before it is carried into the development zone.

Maintaining a narrow trim gap presents issues with respect to the manufacturing of the developer unit. For one, the tolerances for the components that comprise the trim blade that assists in the removal of carrier particles from the upper magnetic roll are more difficult to meet. More precise manufacturing techniques and higher rejection rates increase the unit manufacturing cost for the trim blade. Additionally, a narrower trim gap requires greater torque from the motor driving the roller and it also increases the aging of the developer.

Figure 3:
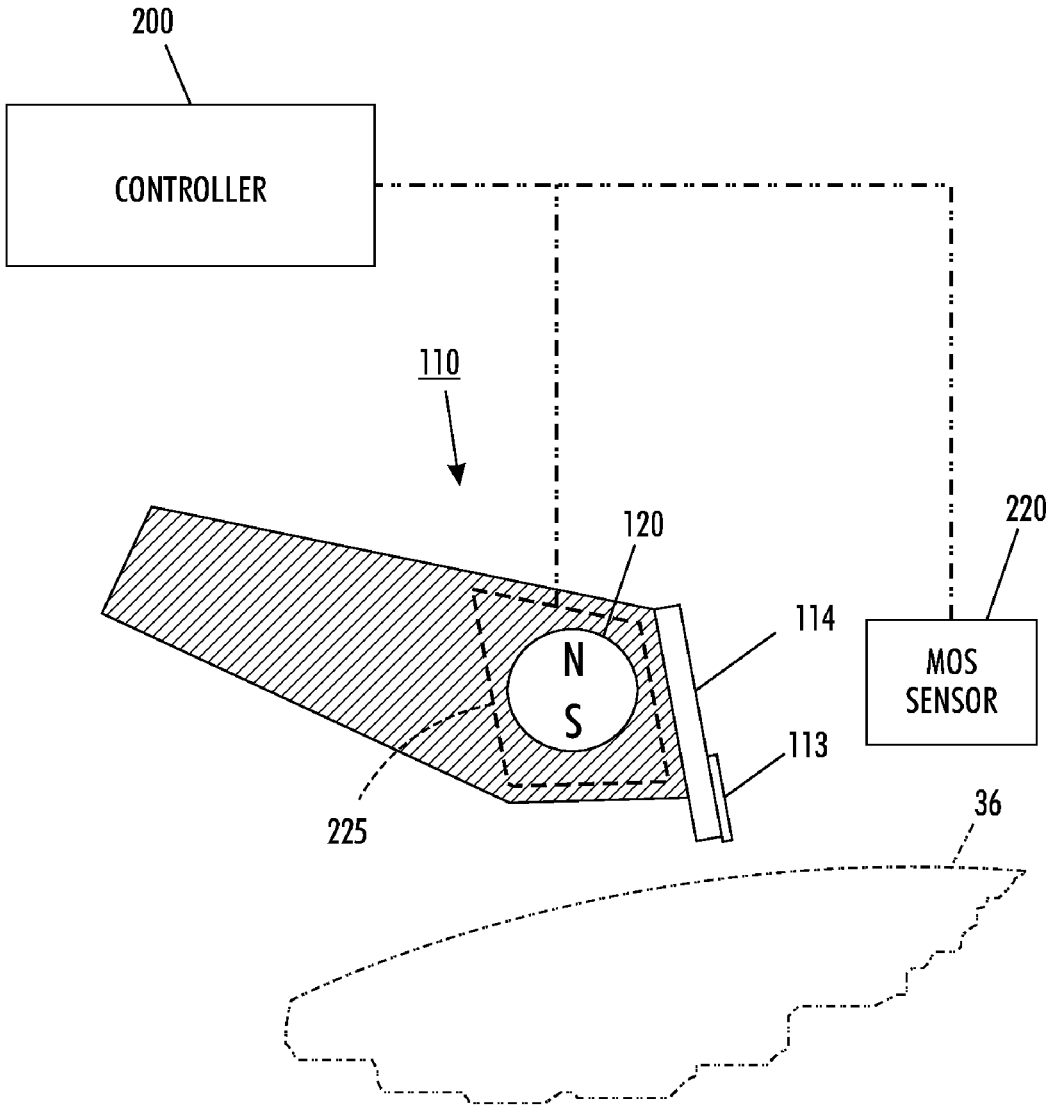
FIG. 3 is a sectional view of the trim system of the present disclosure.
Figure 4:
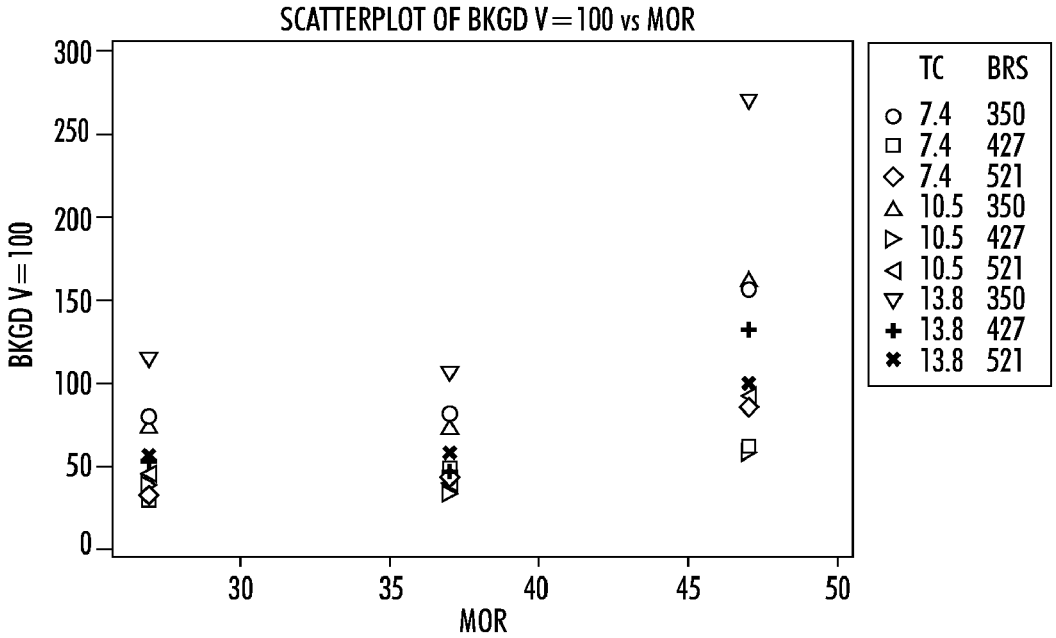
FIG. 4 is experimental data illustrating Xerographic background vs MOR (same as MOS) for constant applied cleaning electric potential.
Figure 5:
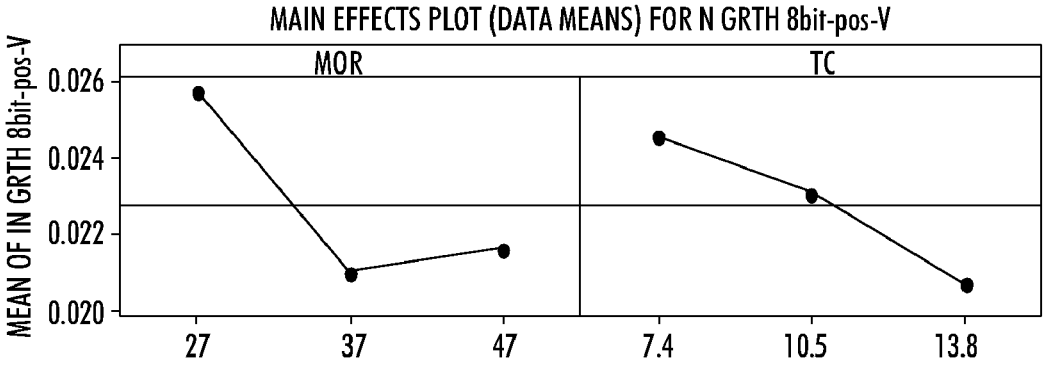
FIG. 5 is experimental data illustrating main effects line growth vs MOR=MOS.
Figure 6:
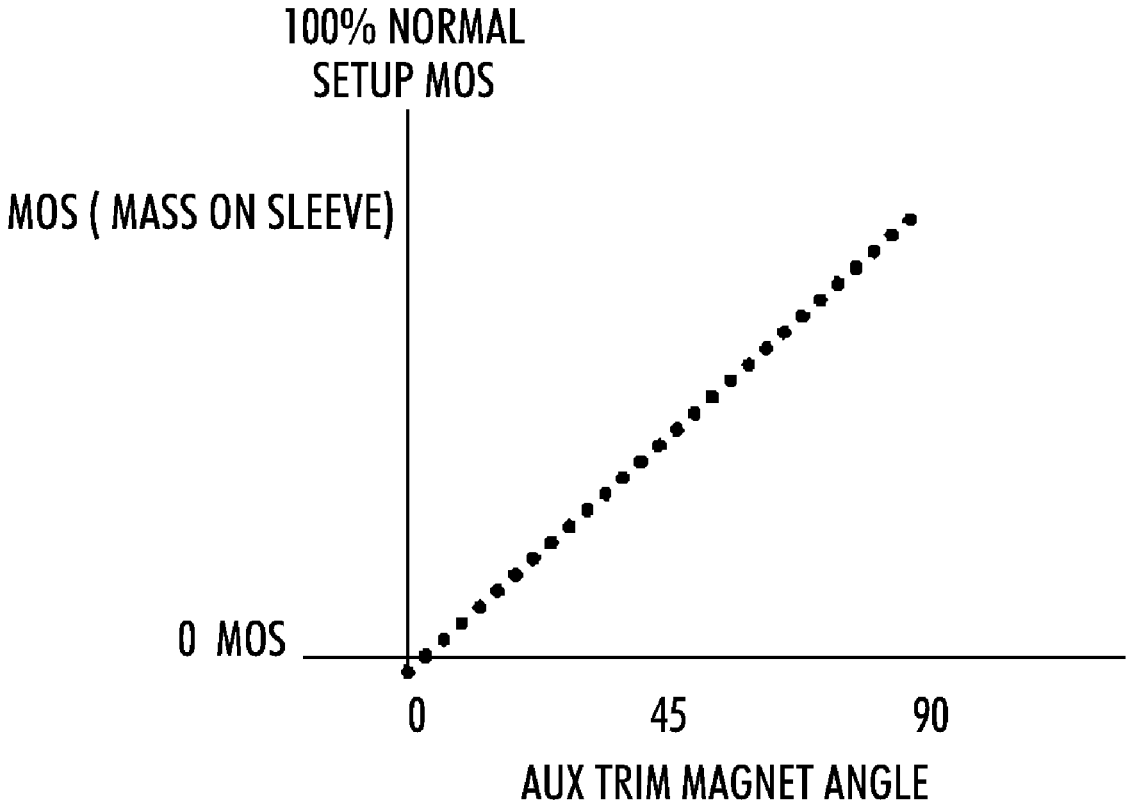
FIG. 6 is experimental data illustrating relation between auxiliary magnet position and mass on roll.

Now focusing on trim bar 110 of the present disclosure, the effect of MOS (mass on mag roll sleeve) on image quality, which is equivalent to MOR (mass on mag roll), is well known. When the MOS goes below a certain value solid area response is lost which leads to component replacement. FIG. 4 shows subtler effect of MOS variation on background. FIG. 5 indicates the effect on line growth which translates into a shift in the tone reproduction curve. As illustrated in FIG. 3, trim bar 110 is mounted a predefined spacing from the donor member 36; a magnetic member 120 is positioned adjacent and along the length of the trim bar 110, the magnetic member 120 coacts with the trim bar 110 to obtain the predefined developer material bed height on the donor member 36. Trim bar 110 includes a non magnetic portion 114 and a magnetic portion 113. A servo motor 225 rotates the magnetic member 120 to vary the magnetic field in a trim zone (not shown) that thereby varies the developer material bed height on the donor member 36. Sensor 220 measures the developer material bed height on the donor member 36 and sends a feedback signal to controller 200 that controls servo motor 225 rotation of the magnetic member 120 in response to the feedback signal sent by sensor 220. Magnetic portion 113 is composed of a ferromagnetic strip which allows the magnetic field from magnetic member to be induced through the ferromagnetic strip.

Figure 7:
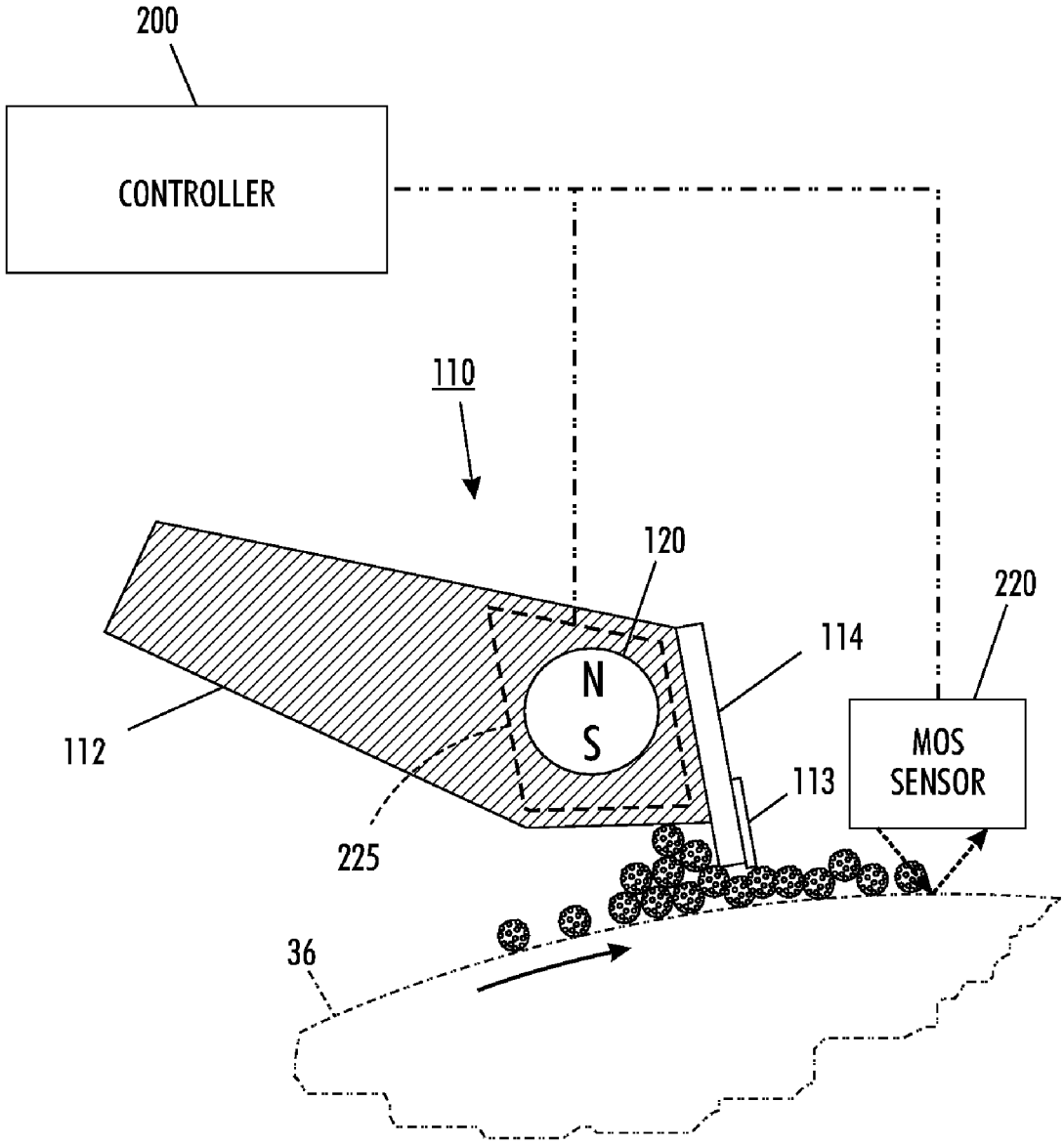
FIG. 7 is a sectional view of the trim system operating at a normal MOS position.
Figure 8:
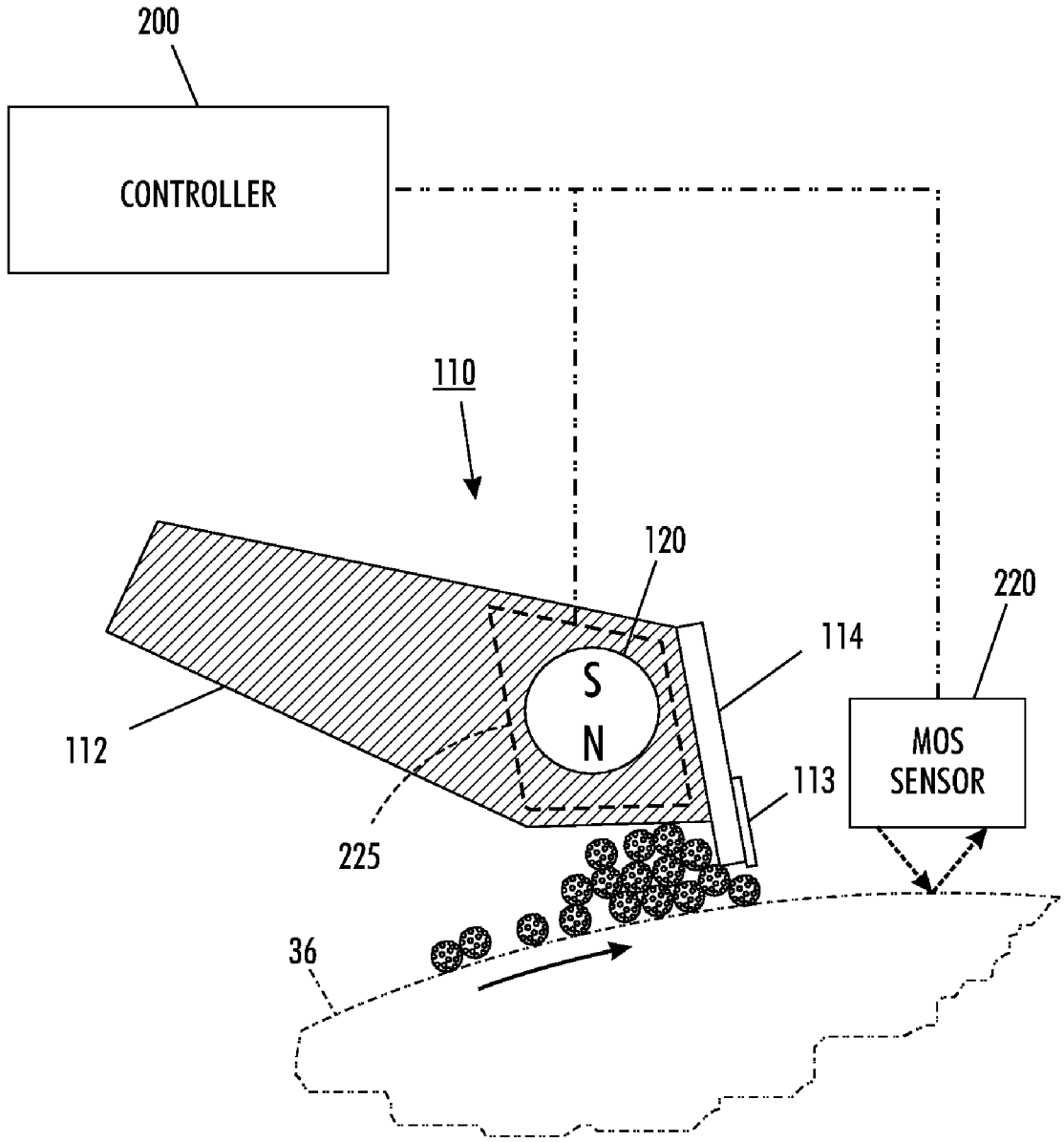
FIG. 8 is a sectional view of the trim system operating to shut down developer flow 0 MOS.

Applicants have found magnetic field modulation at the trim region to modulate the MOS in a predictable way. See FIGS. 7 and 8. It is believed that rotation of the magnetic member 120 changes the field strength at trim creating a constriction for developer flow through trim. The magnetic member introduces an opposing pole which, for this geometry constricts developer flow. The magnitude of this constriction is proportional to the magnitude of the magnetic field parallel to the trim blade. A sensor senses the MOS and instructs the control system to rotate the magnetic member the either increase or decrease the MOS for optimum performance. As illustrated in FIG. 8 magnetic member can be moved to a position to produce 0 MOS that effectively clear the roll which is a desirable feature for multipass systems.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A device for metering developer material to a predefined developer material bed height on a donor member, comprising:

a trim bar being mounted a predefine spacing from said donor member;

a magnetic member positioned adjacent and along the length of said trim bar, said magnetic member coacting with said trim bar to obtain said predefined developer material bed height on the donor member;

means for rotating said magnetic member to vary the magnetic field in a trim zone;

means for measuring the developer material bed height on the donor member; and a controller for controlling said rotating means in response to said measuring means.

2. A development device for metering developer material to a predefined developer material bed height on a donor member, the donor member being at least partially inside the development device and separate from a photoreceptive member, the development device comprising:

a trim bar being mounted a predefine spacing from said donor member;

a magnetic member positioned adjacent and along the length of said trim bar, said magnetic member coacting with said trim bar to obtain said predefined developer material bed height on the donor member, said trim bar comprises a non magnetic portion and a magnetic portion.

3. The device of claim 2, further comprising means for rotating said magnetic member to vary the magnetic field in a trim zone.

4. The device of claim 3, further comprising means for measuring the developer material bed height on the donor member.

5. The device of claim 2, wherein said magnetic portion comprises a ferromagnetic strip.

6. A developer system for developing an image in an electrophotographic printing machine including a developer housing having a toner sump containing a predefine volume of developer material; a development member rotatably mounted in said housing for transferring toner particles to a latent image on said photoreceptive member in a development zone, a device for metering developer material to a predefined developer material bed height on a donor member, said device comprising:

a trim bar being mounted a predefine spacing from said donor member; and a magnetic member positioned adjacent and along the length of said trim bar, said magnetic member coacting with said trim bar to obtain said predefined developer material bed height on the donor member, said trim bar comprises a non magnetic portion and a magnetic portion.

7. The device of claim 6, further comprising means for rotating said magnetic member to vary the magnetic field in a trim zone that thereby varies the developer material bed height on the donor member.

8. The device of claim 7, further comprising means for measuring the developer material bed height on the donor member.

9. The device of claim 8, further comprising a controller for controlling said rotating means in response to said measuring means.

10. The device of claim 6, wherein said magnetic portion comprises a ferromagnetic strip.

* * * * *